US008100175B2

(12) United States Patent
McGuire et al.

(10) Patent No.: US 8,100,175 B2
(45) **Date of Patent: *Jan. 24, 2012**

(54) FRACTURING HEAD WITH REPLACEABLE INSERTS FOR IMPROVED WEAR RESISTANCE AND METHOD OF REFURBISHING SAME

(75) Inventors: Bob McGuire, Meridian, OK (US); L. Murray Dallas, Streetman, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/072,336

(22) Filed: Mar. 25, 2011

(65) Prior Publication Data

US 2011/0168384 A1 Jul. 14, 2011

Related U.S. Application Data

(63) Continuation of application No. 12/612,079, filed on Nov. 4, 2009, now Pat. No. 7,934,546, which is a continuation of application No. 11/725,405, filed on Mar. 19, 2007, now Pat. No. 7,628,201, which is a continuation of application No. 10/979,328, filed on Nov. 2, 2004, now Pat. No. 7,213,641.

(51) Int. Cl.
*E21B 33/03* (2006.01)

(52) U.S. Cl. ..... 166/90.1; 166/177.5

(58) Field of Classification Search ..... 166/90.1, 166/177.5

See application file for complete search history.

(56) References Cited

U.S. PATENT DOCUMENTS

| | | | | |
|---|---|---|---|---|
| 4,377,177 | A * | 3/1983 | Claycomb | 137/15.06 |
| 4,446,887 | A | 5/1984 | Redmon et al. | |
| 5,636,691 | A | 6/1997 | Hendrickson et al. | |
| 5,787,985 | A | 8/1998 | Oneal et al. | |
| 6,176,313 | B1 | 1/2001 | Coenen et al. | |
| 6,491,097 | B1 | 12/2002 | Oneal et al. | |
| 6,557,629 | B2 | 5/2003 | Wong et al. | |
| 7,213,641 | B2 * | 5/2007 | McGuire et al. | 166/90.1 |
| 7,478,673 | B2 | 1/2009 | Boyd | |
| 7,628,201 | B2 * | 12/2009 | McGuire et al. | 166/90.1 |

FOREIGN PATENT DOCUMENTS

| | | | |
|---|---|---|---|
| CA | 2430784 | | 6/2003 |
| CA | 2430784 C | * | 3/2008 |

OTHER PUBLICATIONS

Tree Savers International—Product Catalog (Annotated); 1998.
Loctite America; Application Case History No. 236; 2000.
Rhinofittings; Rhino Stainless Tank Fittings—Rhino Tank Fittings Pressure Test; 2002.

* cited by examiner

*Primary Examiner* — Daniel P Stephenson
(74) *Attorney, Agent, or Firm* — Nelson Mullins Riley & Scarborough, LLP

(57) ABSTRACT

Fracturing heads with one or more replaceable wear-resistant inserts have annular sealing elements for inhibiting fracturing fluids from circulating between the inserts and a main body of the fracturing head. Worn inserts and degraded sealing elements are easily replaced to refurbish the fracturing head without replacing or rebuilding the main body. Service life of the main body is therefore significantly prolonged. In one embodiment, an entire flow path through the main body is lined with wear-resistant replaceable inserts to further prolong the service life of the main body.

20 Claims, 3 Drawing Sheets

FRACTURING HEAD WITH REPLACEABLE INSERTS FOR IMPROVED WEAR RESISTANCE AND METHOD OF REFURBISHING SAME

CROSS-REFERENCE TO RELATED APPLICATIONS

This is a continuation of U.S. patent application Ser. No. 12/612,079 filed Nov. 4, 2009, which was a continuation of U.S. patent application Ser. No. 11/725,405 filed Mar. 19, 2007, now U.S. Pat. No. 7,628,201 which issued on Dec. 8, 2009; which was a continuation of U.S. patent application Ser. No. 10/979,328 filed Nov. 2, 2004, now U.S. Pat. No. 7,213,641 which issued on May 8, 2007.

TECHNICAL FIELD

The present invention relates in general to the fracturing of subterranean hydrocarbon formations and, in particular, to a wear-resistant fracturing head used to pump high pressure fluids and abrasive proppants into a well requiring stimulation.

BACKGROUND OF THE INVENTION

Subterranean hydrocarbon formations are routinely stimulated to enhance their geological permeability. A well known technique for stimulating a hydrocarbon formation is to fracture the formation by pumping into the well highly pressurized fluids containing suspended proppants, such as sand, resin-coated sand, sintered bauxite or other such abrasive particles. A fracturing fluid containing proppants is also known as a "slurry."

As is well known in the art, a fracturing head (or "frac head") has ports to which high pressure conduits known as "frac lines" are connected. The frac lines conduct the highly pressurized slurry from high pressure pumps to the fracturing head. The fracturing head is typically secured to a wellhead valve. The fracturing head includes a main body with a central bore for conveying the slurry downwardly into the well. Due to the high fluid pressures, high transfer rates and the abrasive properties of the proppants in the slurry, components of the fracturing head that are exposed to the pressurized slurry erode or "wash", as such erosion is referred to by those familiar with well fracturing processes.

As is well known in the art, fracturing heads are expensive to manufacture because they are made from hardened tool steel (AISI 4140, for example). Attempts have therefore been made to provide hardened, wear-resistant inserts that can be replaced in order to extend the service life of a fracturing head. For example, published Canadian Patent Application No. 2,430,784 to McLeod et al., describes a fracturing head with a replaceable abrasion-resistant wear sleeve secured in the main bore in the body of the fracturing head. The fracturing head defines a generally Y-shaped flow path. At least two streams of fracturing slurry are pumped through respective side ports angled at approximately 45 degrees to the main bore. The two streams of slurry mix turbulently at a confluence of the side ports. The slurry then flows downstream through the main bore and into the well. The wear sleeve is positioned so that the respective streams of slurry are directed at the wear sleeve rather than at the body of the fracturing head which, being of a softer steel that that of the wear sleeve, is more prone to erosion. However, due to the location of the wear sleeve, the turbulent slurry impinges a top edge of the wear sleeve, which tapers to a feathered edge. The feathered edge of the wear sleeve thus has a tendency to erode. As the feathered top edge erodes, pressurized slurry flows between the wear sleeve and the body of the fracturing head, eroding the body of the fracturing head, causing damage.

Consequently, there exists a need for a fracturing head with improved wear resistance.

SUMMARY OF THE INVENTION

It is therefore an object of the invention to provide a fracturing head with improved wear resistance.

The invention therefore provides a fracturing head comprising: a main body having a wear resistant insert in a main bore of the main body; an annular sealing element disposed around the wear resistant insert to inhibit fracturing fluids pumped through the main bore from penetrating an annular gap between the wear resistant insert and the main body; an auxiliary insert within the main bore downstream of the wear resistant insert; and a retainer ring for retaining the wear resistant insert and the auxiliary insert in the main bore.

The invention further provides a fracturing head comprising: a main body having a main bore that extends from a port in a top end of the main body through a bottom end of the main body; at least two angled side ports in fluid communication with the main bore; a wear resistant insert that is received in the main bore downstream of the angled side ports to protect the main body from fracturing fluids pumped through the angled side ports; an auxiliary insert downstream of the wear resistant insert; and a retainer ring that removably secures the wear resistant insert and the auxiliary insert in the main bore.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

In general, and as will be explained in detail below, a fracturing head in accordance with the invention includes one or more replaceable wear-resistant inserts and annular sealing elements for inhibiting fracturing fluids from circulating between the inserts and a main body of the fracturing head. Worn inserts and degraded sealing elements are easily replaced to refurbish the fracturing head without replacing or rebuilding the main body. Service life of the main body is therefore significantly prolonged. As will be described below, in one embodiment, an entire flow path through the main body is lined with wear-resistant replaceable inserts to further prolong the service life of the main body.

Figure 1:
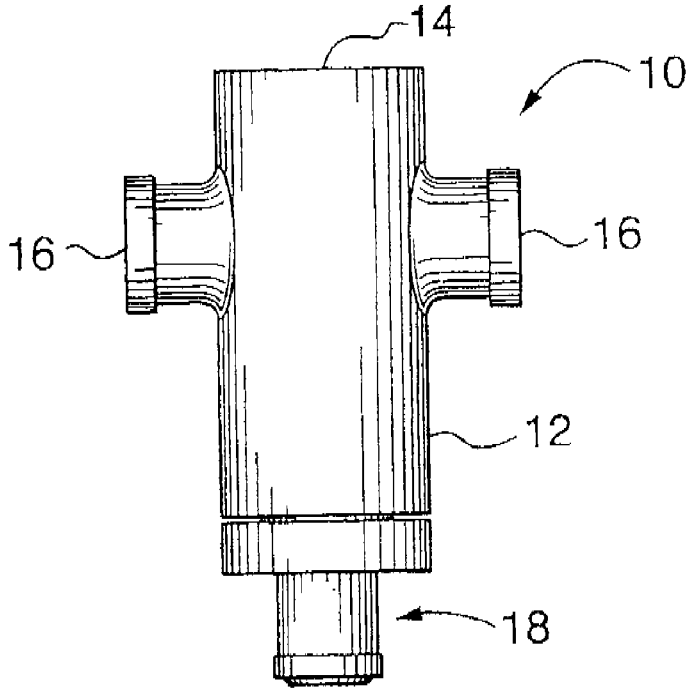
FIG. 1 is a front elevation view of a T-shaped fracturing head in accordance with an embodiment of the invention.
Figure 2:
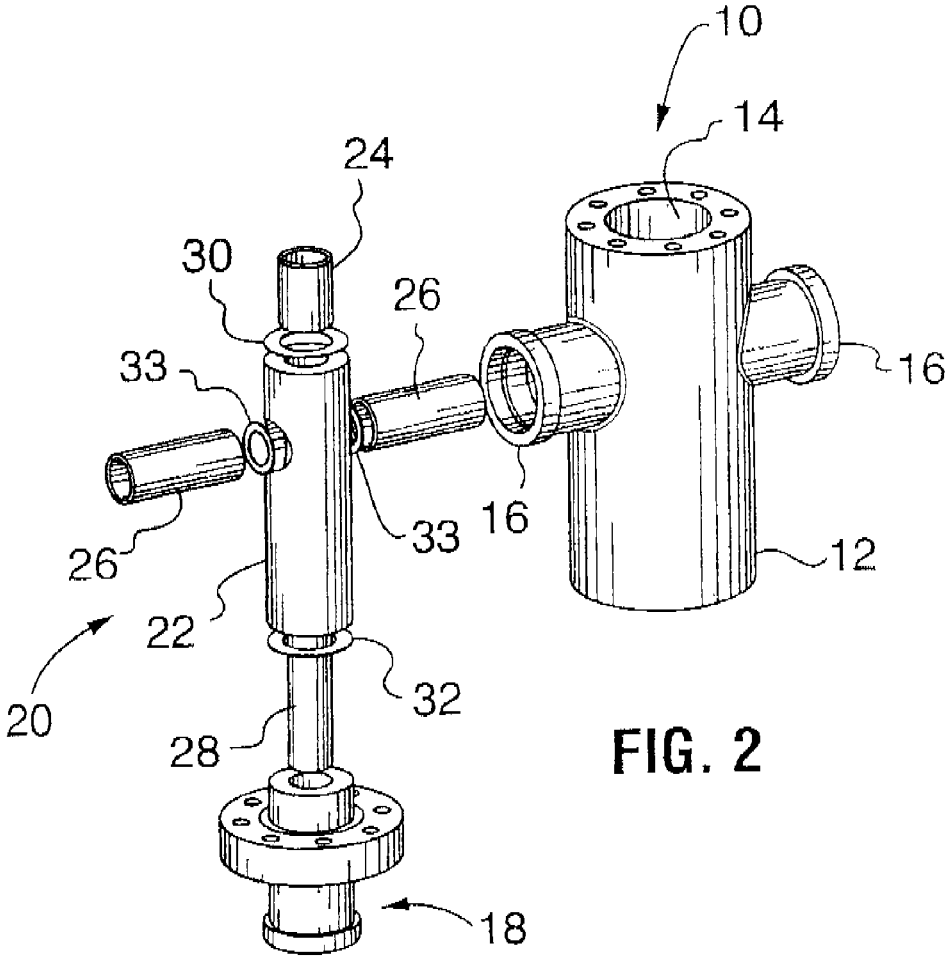
FIG. 2 is an exploded view of the fracturing head shown in FIG. 1.

As shown in FIGS. 1 and 2, a fracturing head 10 in accordance with an embodiment of the invention includes a T-shaped main body 12. The main body 12 includes a top port 14 as well as a pair of opposed side ports 16 to which high-pressure lines (not shown) can be connected and through which pressurized fracturing fluids can then be pumped. As is known in the art, the fracturing fluids include a slurry of treatment fluids and abrasive proppants which the fracturing head 10 conducts down the well for fracturing subterranean hydrocarbon formations. The main body 12 can be secured to the top of a retainer flange which in turn can be secured to a wellhead assembly (not shown).

As shown in FIG. 2, the fracturing head 10 further includes one or more of a plurality of replaceable wear-resistant inserts and annular sealing elements collectively designated by reference numeral 20. The wear-resistant inserts (or "sleeves") and associated annular sealing elements can be secured within one or more bores in the fracturing head 10 in order to provide a wear-resistant flow-path lining that inhibits erosion of the main body 12 and thus prolongs the service life of the fracturing head 10. The various inserts will now be described individually.

As shown in FIG. 2, a main insert 22 can be inserted into a main bore in the main body 12. The main insert 22 is a thick-walled sleeve having circular apertures at top and bottom ends. The main insert 22 further includes, in the cylindrical side wall, two opposed circular apertures each surrounded by an annular lip. The main insert can therefore receive respective side port inserts 26 as well as respective side gaskets 33. The side port inserts 26 are designed to be inserted into respective bores in the opposed side ports 16. Similarly, a top port insert 24 can be inserted into a bore in the top port 14. Furthermore, a retainer flange insert 28 can be inserted into a bore in the retainer flange 18.

An upper annular sealing element 30 and a lower annular sealing element 32 provide fluid-tight seals above and below the main insert 22. The upper annular sealing element 30 is disposed around a top end of the main insert 22 to inhibit the fracturing fluids from penetrating an annular gap between the main insert 22 and the main body 12. The lower annular sealing element 32 is disposed directly beneath the main insert 22, i.e., where the main insert 22 abuts both the retainer flange 18 and a retainer flange insert 28. A pair of side gaskets 33 provide fluid-tight seals between the side port inserts and the main insert 22.

As will be readily appreciated by those of ordinary skill in the art, the fracturing head 10 may include only a single insert and a respective sealing element or it may include any combination of replaceable inserts and annular sealing elements. The inserts and annular sealing elements may be disposed contiguously to provide a protective lining over the entire flow path or merely over only a portion of the flow path.

Figure 3:
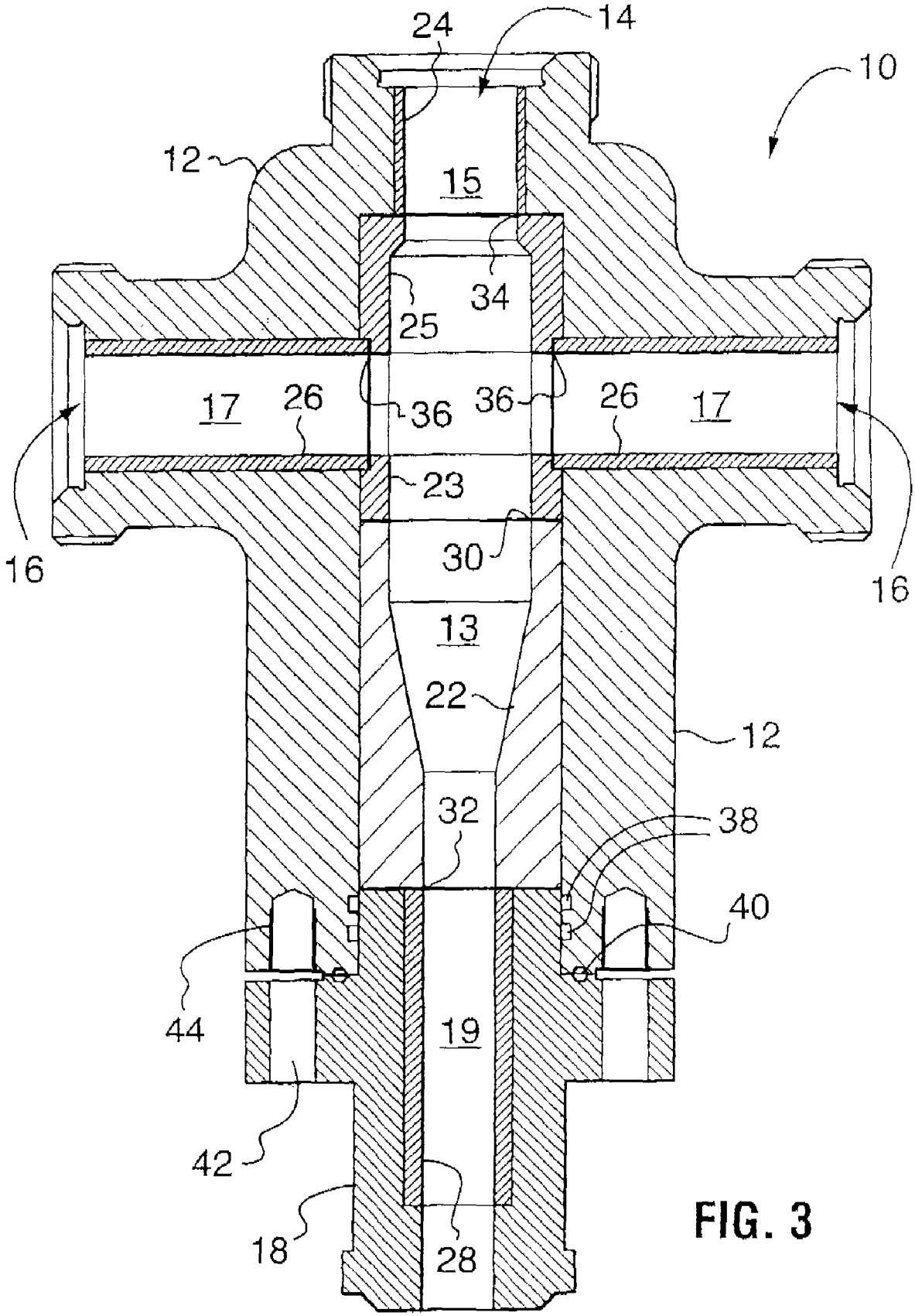
FIG. 3 is a cross-sectional view of another T-shaped fracturing head in accordance with another embodiment of the invention.

FIG. 3 is a cross-sectional view of another T-shaped fracturing head 10 in accordance with another embodiment of the invention. The fracturing head 10 shown in FIG. 3 includes a T-shaped main body 12 having a main bore 13. The main body 12 also includes a top port 14 having a top bore 15 as well as a pair of opposed side ports 16 having respective side bores 17, all of which are in fluid communication with the main bore 13. A retainer flange 18 is secured to the bottom of the main body 12. The retainer flange 18 includes a retainer flange bore 19 which is also in fluid communication with the main bore. The main bore 13, top bore 15, side bores 17 and retainer flange bore 19 together define a flow path through the fracturing head 10.

The side ports 16 and the top port 14 are threaded for the connection of high-pressure lines (not shown) for conducting high-pressure fracturing fluids from a high-pressure pump (not shown) into the well. It is common practice to connect high-pressure lines to two of the three ports for inflow of pressurized fracturing fluids into the fracturing head while the third port is closed with a valve and reserved for pressure alleviation in the event of "screenout". These highly pressurized fracturing fluids mix turbulently at the confluence of the side bores and top bore and then flow downwardly into the well through the main bore 13 and retainer flange bore 19.

As shown in FIG. 3, a main (replaceable wear-resistant) insert 22 is secured within the main bore 13 in the main body 12. In this embodiment, the main insert 22 includes a nozzle with an internal taper used to direct a flow of fluid from the side ports (and/or top port) through a bottom of the fracturing head. Upper and lower main annular sealing elements 30, 32 are disposed along the upper and lower surfaces of the main insert 22 in order to inhibit penetration of abrasive fracturing fluids into an annular gap between the main insert 22 and the main body 12. Consequently, the susceptibility of the main body to erosion is diminished, thus prolonging the service life of the fracturing head.

In the embodiment illustrated in FIG. 3, the fracturing head also includes a second main bore insert 23 secured within the main bore 13 upstream of the first main bore insert 22. The second main bore insert and the first main bore insert 22 are separated by the upper annular sealing element 30.

As shown in FIG. 3, the side bores 17 of each side port 16 are also protectively lined with respective side port inserts 26. Similarly, the top bore 15 of the top port 14 includes first and second top port inserts 24, 25 separated by a top port annular sealing element 34. A pair of side port annular sealing elements 36 are disposed circumferentially around the side bores 17 at the abutment of the side port inserts 26 and the second top port insert 25 and the second main bore insert 23.

As shown in FIG. 3, the retainer flange 18 includes a retainer flange insert 28 within the retainer flange bore 19. The top of the retainer flange insert abuts the lower main annular sealing element 32.

As shown in FIG. 3, a pair of annular grooves 38 are machined into the bottom of the main body 12. Each of the annular grooves 38 receives an O-ring for providing a fluid-tight seal between the bottom of the main body 12 and the retainer flange 18. Further annular grooves 40 are machined into both the bottom of the main body 12 and the top of the retainer flange 18 for accommodating a metal ring gasket as described in applicant's U.S. Pat. No. 7,125,055 which issued Oct. 24, 2006 and is entitled METAL RING GASKET FOR A THREADED UNION.

The retainer flange 18 is secured to the bottom of the main body 12 of the fracturing head 10 using threaded fasteners (which are not shown). The retainer flange 18 includes an upper flange having a plurality of equidistantly spaced bores 42. The bores 42 in the upper flange align with corresponding tapped bores 44 in the bottom of the main body 12.

In one embodiment, the annular sealing elements are ring gaskets made of either a hydrocarbon rubber (such as Viton® Nordel® available from Dow Chemical) or a polyurethane.

In one embodiment, the main body 12 and the retainer flange 18 are machined from AISI 4140 heat-treated steel whereas the inserts are machined from a harder steel such as AISI 4340 steel having a Rockwell C Hardness of 48-56.

Figure 4:
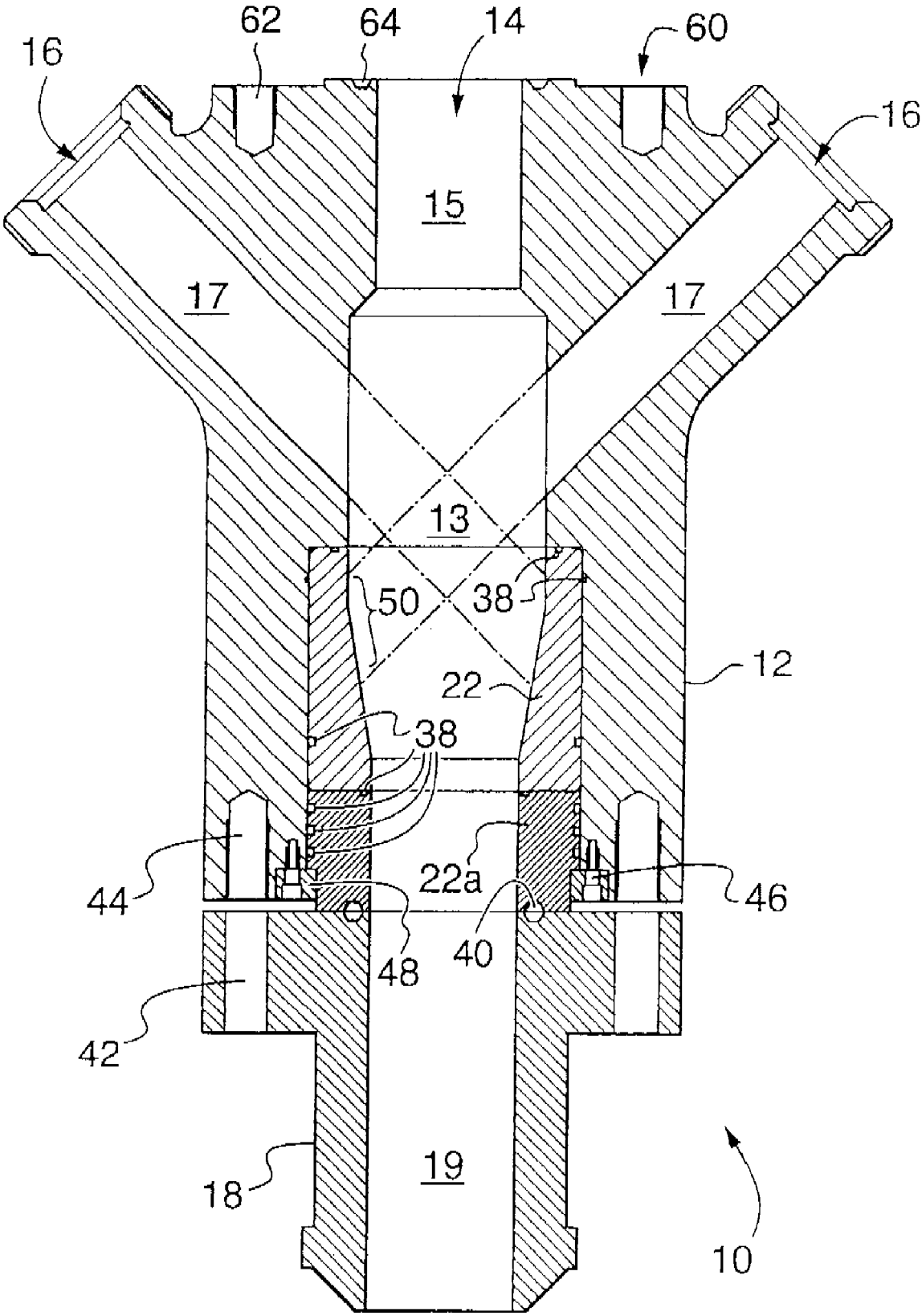
FIG. 4 is a cross-sectional view of a Y-shaped fracturing head in accordance with yet a further embodiment of the invention.

FIG. 4 is a cross-sectional view of a Y-shaped fracturing head in accordance with yet a further embodiment of the invention. In this embodiment, the fracturing head 10 includes two angled side ports 16 each having a side bore 17 in fluid communication with a main bore 13. In use, high-pressure lines are connected to the angled side ports 16 and/or to the top port in the manner described above. High-pressure fracturing fluids are thus conducted at high velocity down the side bores and/or top bore. These fracturing fluids mix turbulently at the confluence of the main bore, top bore and side bores and the fluids flow downwardly into the well through the main bore 13 and the retainer flange bore 19.

As shown in FIG. 4, a main replaceable wear-resistant insert 22 is secured in the main bore 13 downstream of the side ports 16. The main insert 22 has an impingement surface 50 against which substantially all of a jet of pressurized fracturing fluids directly impinges when pressurized fracturing fluids are pumped through one or more of the angled side ports 16. The impingement surface 50 is a portion of the exposed inner surface of the main insert that is spaced far enough beneath the top of the main insert that substantially none of the jet impinges on the interface between the top of the main insert and the main body. In other words, the main replaceable wear-resistant insert 22 is positioned within the main bore so that the fracturing fluids pumped through the angled side ports generally impinge only the impingement surface 50 spaced beneath the top surface of the insert and above a bottom surface of the insert.

As shown in FIG. 4, the fracturing head 10 may further include one or more annular grooves 38 that are machined into the main insert and/or the main body. These annular grooves 38 each accommodate an O-ring for providing a fluid-tight seal between the main insert 22 and the main body. The O-rings inhibit fracturing fluids from penetrating between the main insert and the main body. As noted above, the seals inhibit erosion of the main body and thus prolong the service life of the fracturing head.

As shown in FIG. 4, the fracturing head 10 further includes an auxiliary replaceable wear-resistant insert 22*a* that is secured within the main bore 13 downstream of the main insert 22. The auxiliary insert 22*a* includes a top annular groove in which an O-ring is seated for providing a fluid-tight seal between the auxiliary insert 22*a* and the main insert 22. The auxiliary insert 22*a* also includes three peripheral annular grooves 38 in which O-rings are seated for providing a fluid-tight seal between the auxiliary insert 22*a* and the bottom of the main body 12. In addition, the auxiliary insert 22*a* includes a bottom annular groove 40 (corresponding to an annular groove in the top of the retainer flange 18) in which a metal ring gasket can be seated to provide a fluid-tight seal between the top of the retainer flange and the bottom of the auxiliary insert.

As shown in FIG. 4, the auxiliary insert 22*a* is retained within the bore 13 by a retainer ring 48 which, in turn, is fastened to the bottom of the main body with threaded fasteners 46. As was noted above with respect to the previous embodiment, the retainer flange 18 is secured to the main body 12 using fasteners that are inserted through boreholes 42 and threaded into tapped boreholes 44.

As shown in FIG. 4, at the top of the fracturing head 10 is a stud pad 60 having tapped boreholes 62 as well as an annular groove in which a metal ring gasket can be seated. The stud pad 60 permits stacking of two or more fracturing heads.

In one embodiment, the main body 12, retainer flange 18, retainer ring 48 and auxiliary insert 22*a* are machined from AISI 4140 heat-treated steel. The main insert 22, against which the fracturing fluid impinges, is machined from a harder steel such as AISI 4340 steel having a Rockwell C Hardness of 48-56. The auxiliary insert is made of a softer, more elastic steel which compresses more readily than the 4340 steel of the main insert 22, and thus permits the retainer flange to be fastened tightly to the bottom of the main body without risk of cracking the brittle main insert 22.

The service life of the fracturing head can be prolonged by replacing worn inserts and/or worn annular sealing elements. To refurbish the fracturing head, the fracturing head is disassembled by detaching the main body from the retainer flange. The inserts and sealing elements can then be removed and inspected. Any worn inserts and/or sealing elements can then be replaced before the fracturing head is reassembled.

Persons of ordinary skill in the art will appreciate, in light of this specification, that minor variations may be made to the components of the fracturing head without departing from the spirit and scope of the invention. The embodiments of the invention described above are therefore intended to be exemplary only and the scope of the invention is limited only by the scope of the appended claims.

We claim:

1. A fracturing head comprising:

a main body having a wear resistant insert in a main bore of the main body;

an annular sealing element disposed around the wear resistant insert to inhibit fracturing fluids pumped through the main bore from penetrating an annular gap between the wear resistant insert and the main body;

an auxiliary insert within the main bore downstream of the wear resistant insert; and a retainer ring for retaining the wear resistant insert and the auxiliary insert in the main bore, the retainer ring being received in an annular groove in a bottom of the main body.

2. The fracturing head as claimed in claim 1 further comprising a retainer flange connected to a bottom of the main body to secure the fracturing head to a wellhead assembly.

3. The fracturing head as claimed in claim 2 wherein the a bottom end of the auxiliary insert further comprises an annular groove in which a metal ring gasket is seated to provide a fluid-tight seal between the bottom end of the auxiliary insert and a top end of the retainer flange.

4. The fracturing head as claimed in claim 1 wherein the main body comprises a plurality of angled side ports.

5. The fracturing head as claimed in claim 4 wherein the wear resistant insert comprises an impingement surface against which substantially all pressurized fracturing fluid impinges that is pumped through any one or more of the angled side ports.

6. The fracturing head as claimed in claim 1 wherein a top end of the fracturing head comprises a stud pad having tapped boreholes and an annular groove adapted to receive a metal ring gasket.

7. The fracturing head as claimed in claim 1 wherein the wear resistant insert and the auxiliary insert are respectively steel inserts, and the auxiliary insert is constructed of a softer, more resilient steel than the wear resistant insert.

8. The fracturing head as claimed in claim 7 wherein the auxiliary insert is machined from AISI 4140 heat-treated steel.

9. The fracturing head as claimed in claim 7 wherein the wear resistant insert is machined from AISI 4340 steel having a Rockwell C Hardness of 48-56.

10. The fracturing head as claimed in claim 1 wherein the auxiliary insert comprises a top annular groove in which an O-ring is seated to provide a fluid-tight seal between the wear resistant insert and the auxiliary insert.

11. The fracturing head as claimed in claim 1 wherein the auxiliary insert comprises at least one peripheral annular groove in which an O-ring is seated to provide a fluid-tight seal between the auxiliary insert the main body.

12. The fracturing head as claimed in claim 1 wherein the retainer ring is fastened to the main body by a plurality of threaded fasteners.

13. The fracturing head as claimed in claim 1 further comprising a plurality of O-rings disposed between the wear resistant insert and the main body for inhibiting the fracturing fluids from penetrating the annular gap between the wear resistant insert and the main body.

14. A fracturing head comprising:

a main body having a main bore that extends from a port in a top end of the main body through a bottom end of the main body;

at least two angled side ports in fluid communication with the main bore;

a wear resistant insert that is received in the main bore downstream of the angled side ports to protect the main body from fracturing fluids pumped through the angled side ports;

an auxiliary insert downstream of the wear resistant insert; and a retainer ring that removably secures the wear resistant insert and the auxiliary insert in the main bore, the retainer ring being received in an annular groove in a bottom of the main body.

15. The fracturing head as claimed in claim 14 further comprising a retainer flange connected to a bottom of the main body to directly or indirectly secure the fracturing head to a wellhead assembly.

16. The fracturing head as claimed in claim 14 wherein the retainer ring is secured to a bottom end of the fracturing head by a plurality of threaded fasteners.

17. The fracturing head as claimed in claim 14 wherein the wear resistant insert comprises an impingement surface against which impinges substantially all pressurized fracturing fluid that is pumped through any one or more of the angled side ports.

18. The fracturing head as claimed in claim 14 further comprising at least one fluid seal disposed between the wear resistant insert and the main body to inhibit fracturing fluids pumped through the main bore from penetrating an annular gap between the wear resistant insert and the main body.

19. The fracturing head as claimed in claim 14 further comprising at least one fluid seal disposed between the auxiliary insert and the main body to inhibit fracturing fluids pumped through the main bore from penetrating an annular gap between the auxiliary insert and the main body.

20. The fracturing head as claimed in claim 14 further comprising a fluid seal between a bottom end of the wear resistant insert and a top end of the auxiliary insert to provide a fluid-tight seal between the wear resistant insert and the auxiliary insert.

* * * * *

UNITED STATES PATENT AND TRADEMARK OFFICE

CERTIFICATE OF CORRECTION

PATENT NO. : 8,100,175 B2
APPLICATION NO. : 13/072336
DATED : January 24, 2012
INVENTOR(S) : Bob McGuire and L. Murray Dallas It is certified that error appears in the above-identified patent and that said Letters Patent is hereby corrected as shown below:

In the specification:
In the specification, column 3, line 9, please add the number --18-- after the word “flange”.
In the specification, column 4, line 66, please add the number --14-- after the word “port”.

Signed and Sealed this
Second Day of October, 2012

David J. Kappos

David J. Kappos
*Director of the United States Patent and Trademark Office*